United States Patent [19]

Roy

[11] Patent Number: 5,032,090

[45] Date of Patent: Jul. 16, 1991

[54] SNAP-IN-TERMINALS FOR WEDGE-BASE BULBS

[75] Inventor: Dhirendra C. Roy, Canton, Mich.

[73] Assignee: United Technologies Automotive, Inc., Dearborn, Mich.

[21] Appl. No.: 409,838

[22] Filed: Sep. 20, 1989

[51] Int. Cl.[5] ..... H01R 19/00

[52] U.S. Cl. ..... 439/619; 439/699; 313/318

[58] Field of Search ..... 313/315, 317, 318; 439/611, 612, 613, 619, 699, 356, 842, 856, 857, 862

[56] References Cited

U.S. PATENT DOCUMENTS

| | | | |
|---|---|---|---|
| 3,017,599 | 1/1962 | Loesch | 439/699 X |
| 3,999,095 | 12/1976 | Pearce, Jr. et al. | 439/699 X |
| 4,720,272 | 1/1988 | Durand | 439/619 X |
| 4,883,434 | 11/1989 | Toyoshima | 439/619 |
| 4,902,251 | 2/1990 | Grzena | 439/699 |

*Primary Examiner*—Neil Abrams
*Assistant Examiner*—Khiem Nguyen

[57] ABSTRACT

A subminiature terminal (10; FIGS. 5 and 6A & 6B) for mechanically holding and electrically interconnecting a wedge-base bulb (1; FIGS. 1 & 2) into a circuit in, for example, an automotive application, in which the electrical and mechanical retention forces balance out, in a preferred manner (FIGS. 4 & 4A), preventing undesired rotation (tilting) of the bulb held between opposed terminal pairs seated in a connector system (not illustrated). The terminal includes conductor and insulation grips (11), a body or base (12) (the structural part), a mechanical retention spring (13), and an electrical contact spring (14). The mechanical retention spring is a leaf spring clamped at the rear and dimensioned to hold the bulb at its detent; while the electrical contact spring is a torsion spring on the opposite side approximately a one half winding (14A) formed between two lever arms, one lever arm (14B) clamped at the front of the terminal, while the other one (14C) is essentially free to deflect, as required by the wedge-base (3) of the bulb (1) to ensure electrical contact independent of filament wire deformation or its history. The free arm is smooth along its length and in particular in its contact surfaces with its respective filament wire.

4 Claims, 3 Drawing Sheets

SNAP-IN-TERMINALS FOR WEDGE-BASE BULBS

DESCRIPTION

1. Technical Field

The present invention relates to electrical connector systems for electrically and mechanically interconnecting a wedge-base type bulb, which typically has two exterior filament wires, into a circuit through the electrical and mechanical interconnections provided by conductive terminals More particularly, the present invention is directed to a snap-in type terminal strip used to mechanically and electrically interconnect and hold a wedge-base type bulb which can be subminiature in size. Even more particularly, the present invention is directed to simplifying the terminal member used especially for electrical connectors used in the automotive industry to hold and electrically interconnect a subminiature wedge-base type bulb using a snap-in type electrical/mechanical terminal connector.

2. Background Art

Electrical bulbs of miniature and subminiature sizes, that automotive industries generally use, are designed with very liberal dimensional tolerances. A standard type of bulb used for such electrical illumination is the wedge-base bulb (an exemplary one being illustrated in FIG. 1 hereof).

Such a wedge-base type bulb includes two externally extended, electrical filament wires, which can be considered the most important parts of the bulb. These wires are very thin and susceptible to easy deformation.

Indeed, occasionally, they are found to be dislocated in such an extreme manner that electrical continuity cannot be warranted (see, for example, the bent wires of FIG. 2 hereof). In the invention the design parameters for terminals and sockets therefore are selected in order to overcome this specific warranty problem, in addition to other problems already known.

The terminals, as currently available for wedgebase bulb sockets, can be classified as two basic types.

One type is of a very conventional nature, and the electrical contact point is presumed to be just opposite to the mechanical retention point, a presumption which does not always hold true.

A second type suggests using a redundant electrical contact along with a wire straightening feature, and both are added to a conventional terminal [see, e.g., U.S. Pat. No. 4,720,272 of Durand (Chrysler Motors Corp.) issued Jan. 19, 1988].

However, a systematic engineering analysis done as part of the invention indicates that neither type is capable of providing optimum results. The wire guide in some cases cannot reach extremely skewed filament wires, such as those shown in FIG. 2 hereof, and the terminal base cannot align skewed filament wires to the extreme outer edge of the side wings of the bulb. (For details, again see Patent No. 4,720,272.)

Some of the "incentives" which led to the present invention include the following.

1. Bulb wires are very sensitive to mechanical loads and can easily be out of position (see FIG. 2 hereof).

2. Bulb manufacturers are reluctant to change the state of the art.

3. The terminals of the second type identified above are very complex in nature and do not consistently function.

4. The existing art does not provide an optimum contact resistance, providing room for improvement.

5. In the prior art the mechanical retention forces and the electrical contact forces acting on a bulb lie on one plane. Technically, this situation makes the bulb dynamically instable (see FIG. 3 hereof).

6. Economics of the existing art are not attractive. Terminals of the second type are of a complex configuration and thus relatively expensive.

DISCLOSURE OF INVENTION

The present invention in its preferred embodiment utilizes a snap-in terminal especially for subminiature bulbs. The terminals of the invention are not only mechanically and electrically superior in many respects, but also simple in their configurations. They are relatively inexpensive and capable of meeting all of the technical requirements for wedge-base type bulbs.

The invention's terminals engaged with a wedge-base bulb constitute an unique system assembly, in that the bulb finds a well defined position and becomes mechanically stable. An improved and consistent electrical contact is guaranteed at the rear or bottom of the bulb, namely at the root of the bulb's filament wires, by means of using a flexible lever in the form of a torsion spring having nearly a one half (½) winding. History and the position of the bulb wires have essentially no effect on the electrical performances of the assembly.

It is thus a basic object of the present invention to design a terminal, specifically applicable to subminiature wedge-base bulbs, that considers only one electrical contact at a specific location and at the same time provides added electrical reliability and mechanical stability, with the positioning of the bulb wires having no effect.

The following are further preferred objects or goals of the present invention:

1. The terminal should provide an improved and consistent electrical contact area as compared to the prior art.

2. The position of a bulb is well defined with respect to the proposed terminals properly seated within a connector system.

3. The terminals should keep the bulbs dynamically stable because the forces acting on the bulb are not co-planar. In the invention mechanical retention forces and the electrical contact forces lie on two different planes, and thus keep the bulb stable (see FIG. 4 hereof).

4. The terminals are simple in configuration, and so they are likely to be relatively inexpensive (see the simple, folded terminal structure illustrated in FIG. 5 hereof).

5. History and positioning of the bulb wires have no effect on the overall performance of the bulb/socket assembly.

Other features and advantages will be apparent from the specification and claims and from the accompanying drawings, which illustrate one exemplary embodiment of the invention.

BRIEF DESCRIPTION OF DRAWINGS

FIG. 3 is a schematic diagram of an exemplary prior art system showing the forces acting on the bottom, wedge base portion of the bulb as viewed from one side (as can be seen, the mechanical retention forces $F_{MECH}$ and the electrical contact forces $F_{ELEC}$ are co-planar, i.e., they are all applied in the same plane); while

FIG. 4 is a schematic diagram of the preferred, exemplary embodiment of the present invention showing the forces acting on the bottom, wedge base portion of the bulb as viewed from one side (as can be seen the mechanical retention forces $F_{MECH}$ and the electrical contact forces $F_{ELEC}$ are applied in two different planes); while

BEST MODE FOR CARRYING OUT THE INVENTION

Exemplary Wedge-Base Bulb

Figure 2:
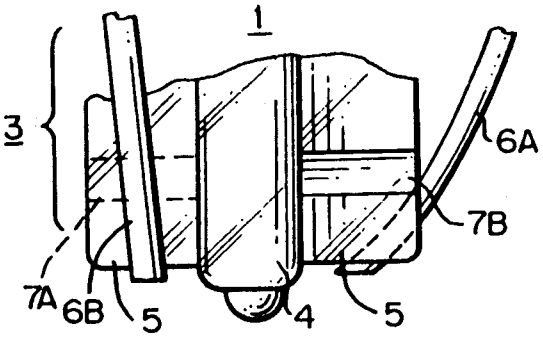
FIG. 2 is a partial view illustrating the bottom or wedge-shape end of the bulb of FIG. 1 showing the wires bent to the side out of position, particularly at the "rear" end, i.e., the root, of the wire.
Figure 1:
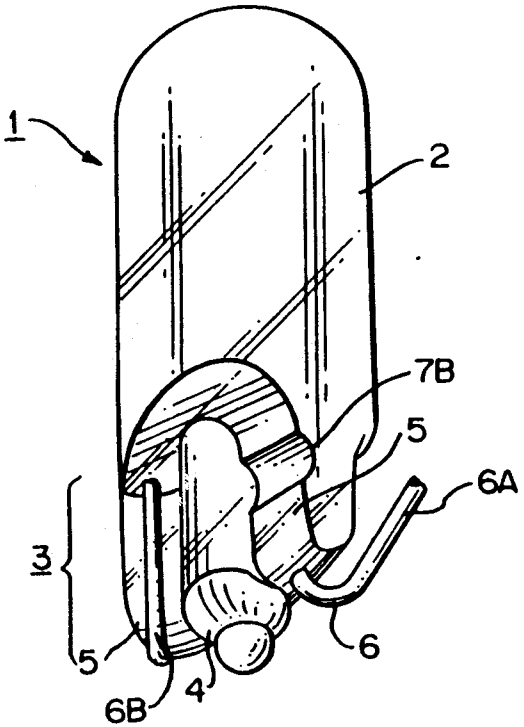
FIG. 1 is a perspective view illustrating a typical wedge-base bulb showing the pin electrical filament wires and detents for mechanical retention to which the present invention is applied.

As described in the '272 patent and illustrated in FIGS. 1 & 2, a typical wedge-base bulb 1, as used in the automotive industry, is made up of a bulbular evacuated chamber 2 fused to a wedge-base 3 The wedge-base configuration includes a raised, centrally located, cylindrical vent tube 4 running along the central longitudinal axis of the bulb 1 The vent tube 4 is bound on both sides by laterally extended side wings 5.

The bulb 1 also has a lamp filament wire 6, which extends through and out the bottom end of the side wings 5 in such a manner that on either side of the vent tube 4 there is only one end of the filament wire, one on each side (6A, 6B). There is thus one wire 6A on the "front" side of the wedge-base 3, and one wire 6B on the other or "back" side of the bulb 1.

The wedge-base 3 also has two, concave detents or troughs 7A, 7B extending transversely to the longitudinal axis of the bulb 1, one on each side of the bulb 1, extending across approximately one-half ($\frac{1}{2}$) of its width. Each detent trough 7A, 7B is located on the opposite side of the central hub 4 in relation to its respective filament wire 6A, 6B, respectively. Thus, with reference to FIG. 1, detent 7B is on the opposite side of the hub 4 from the filament wire 6B; while the detent 7A is on the same wing section 5 as is the filament wire 6B.

The next component of the typical socket assembly is the snap-in lamp terminal, the particulars of which is what the present invention is directed to and which will be described in detail below. However, in general a typical snap-in lamp terminal is made up of a "U" channel shaped body, extending longitudinally, with surrounding contact arms (springs) attached to each of the opposite sides.

As is well known to the art, the terminal is ultimately incorporated into a socket body, and the wedge-base portion 3 of the bulb 1 is inserted in between the extended channel bodies of two opposed terminals, with each of the opposed terminals making electrical contact with a respective one of the filament wires 6A or 6B (see e.q. the '272 patent). Thus, one terminal would mechanically grasp a detent (such as 7A) and the wire on the opposite side of the base (e.q. wire 6B), while the other terminal would mechanically grasp and electrically contact the other detent (e.g. 7B) and wire (e.g. 6A).

Figure 3:
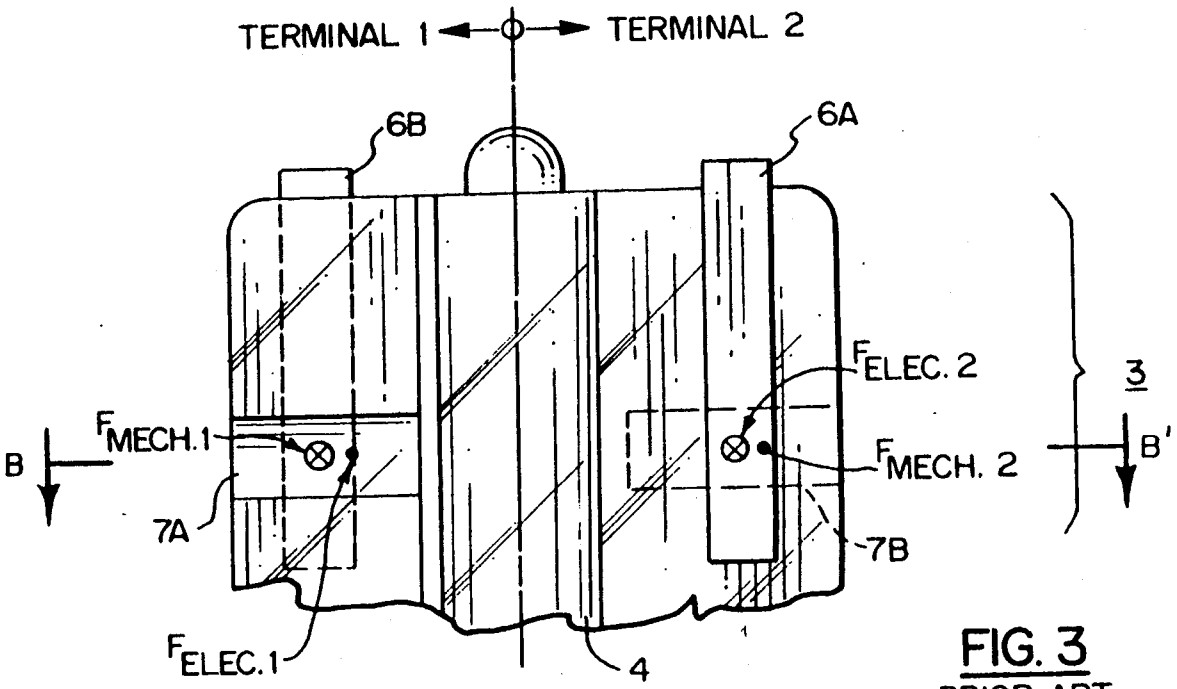
FIG. 3 PRIOR ART
Figure 3B:
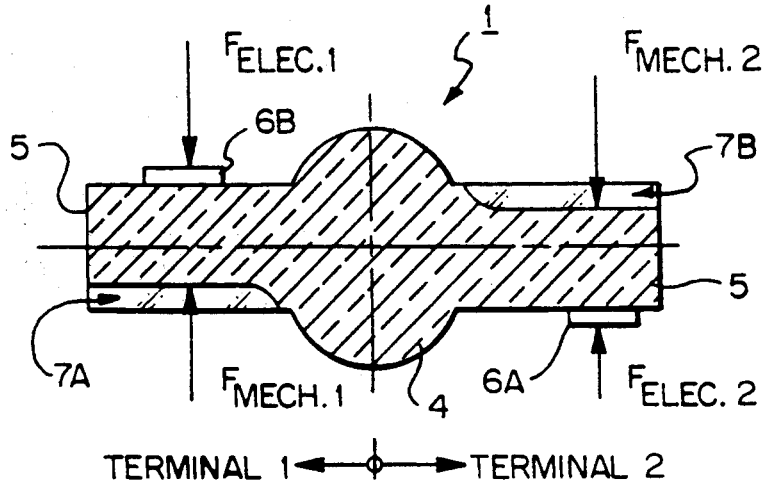
FIG. 3B PRIOR ART
FIG. 3B is a schematic diagram of the exemplary prior art system of FIG. 3 showing the same co-planar forces acting on a cross-section (taken along section line B-B' of FIG. 3) of the bottom or base of the bulb of FIG. 1 as exerted by the spring sections of the conventional, prior art terminals.

The multiple contacts of the prior art approach, as typified in the '272 patent and as diagrammatically indicated in FIGS. 3 & 3B, are co-planar. Additionally, the prior art as typified in the '272 patent used a relatively complex contacting arm structure, including, for example, three contacting elements on one side of a single terminal, namely, concave spring contact 90 (on contact arm 88), wire guide means 92 and cantilevered redundant terminal 96 (note FIG. 10 of the '272 patent).

In contrast, the relatively simple contacting elements of the terminals of the present invention, described below, use a relatively simple design which uses only one contacting element on a side, preferably in the form of a torsion spring for the electrical contact. The spring elements contact the wedge-base 3 of the bulb 1 at different, parallel planes, i.e., at longitudinally spaced points or areas, along the length of the wedge-base, all as diagrammatically illustrated in FIGS. 4 & 4A.

Terminal (10) of Invention

Figure 5:
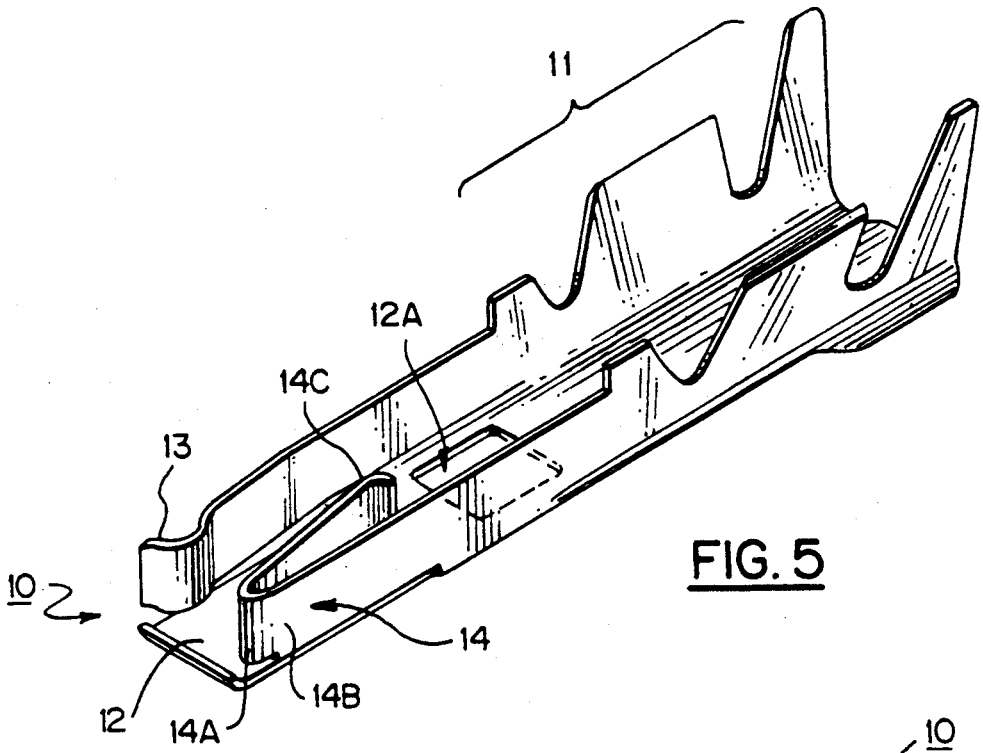
FIG. 5 is a perspective view of the preferred, exemplary terminal of the invention which produces the non-planar forces of FIG. 4.
Figure 6A:
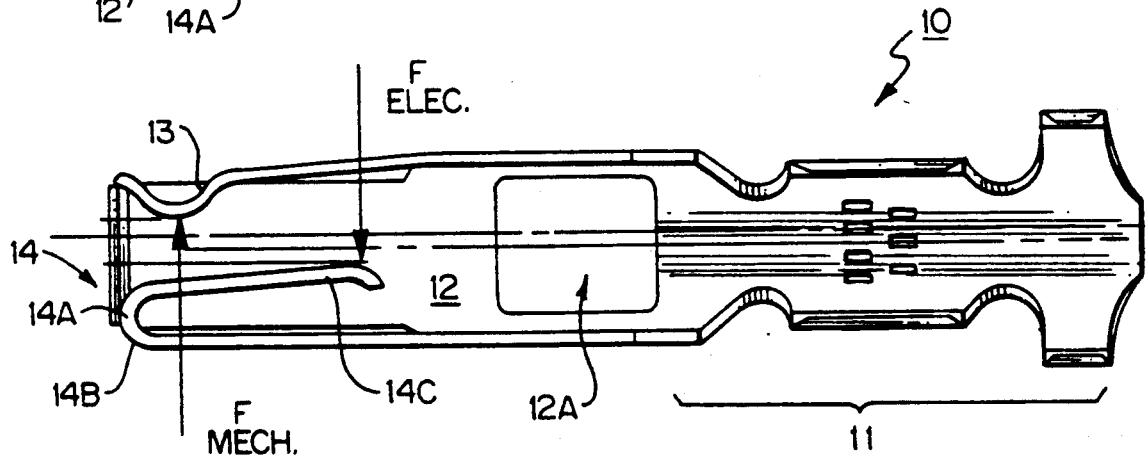
FIG. 6A & 6B are plan and side views, respectively, of the terminal of FIG. 5.
Figure 6B:
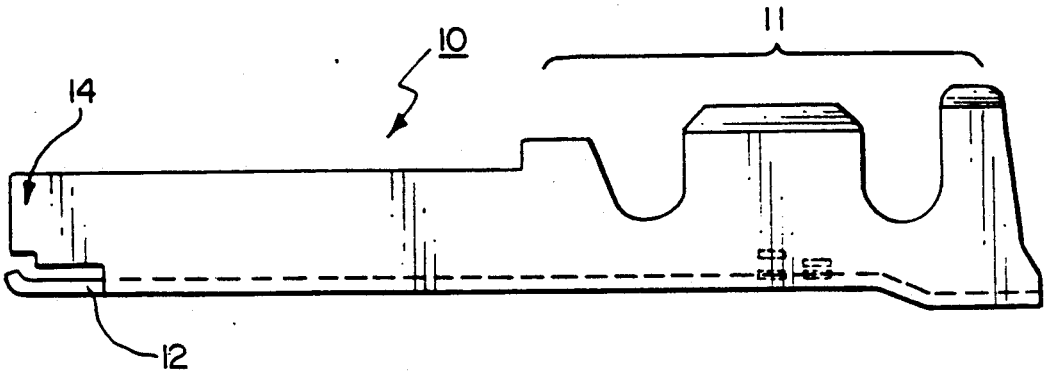

The preferred, exemplary embodiment of the terminal 10 of the present invention has four major elements (see FIG. 5 and FIGS. 6A & 6B).

1. conductor and insulation grips 11;
2. a body or base 12 (the structural part);
3. a mechanical retention spring 13; and
4. an electrical contact spring 14.

The conductor and insulation grips 11 are located at the rear half or end of the terminal (see FIGS. 6A & 6B) and are used to connect the terminal 10 to an electrically conductive wire, which in turn is used to connect the bulb 1 into a circuit. The body 12 is essentially a flat plate having a hole 12A essentially in its middle. The hole 12A is meant for locking the terminal 10 in the cavity of a socket (not illustrated for simplicity purposes but well known to those of ordinary skill).

As noted above, each terminal 10 has two springs. One 13 serves as a mechanical retention spring, and it mechanically holds the bulb 1. The other 14 serves as an electrical contact spring to provide electrical continuity between the filament wire 6A or 6B, whichever one it contacts, and the wire connected to the grips 11.

As in the prior art, in the invention, two, opposed, identical terminals (each identical to the terminal 10 illustrated in FIGS. 5 and 6A & 6B) are used to receive and engage opposite wings 5 of the bulb 1. The forces exerted by the mechanical and electrical springs are identified as $F_{MECH}$ and $F_{ELEC}$, respectively, with the numerical sub-designation "1" referring to the first terminal 11, and the numerical sub-designation "2" referring to the other, opposed or second terminal 10 used to form the pair for opposite side edges of the bulb 1. (Note FIG. 4.)

Figure 4:
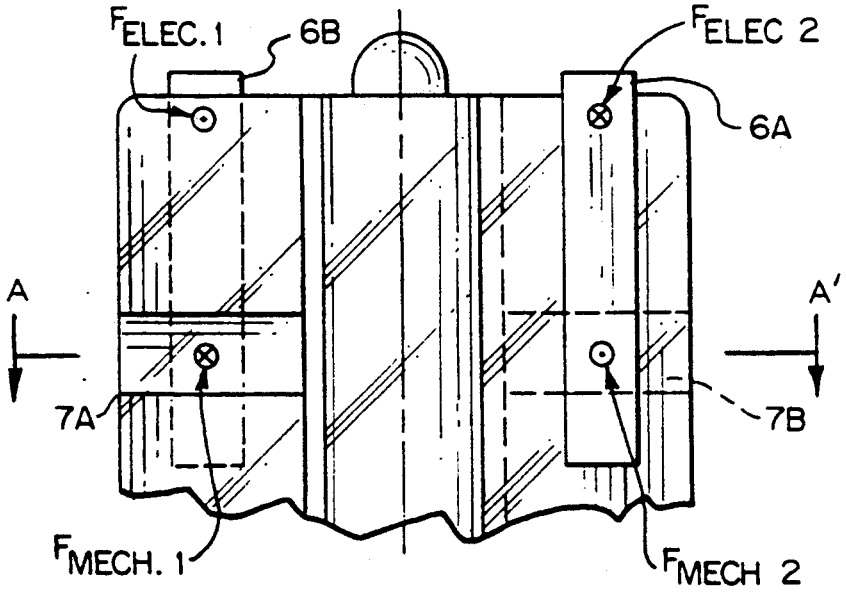
Figure 4A:
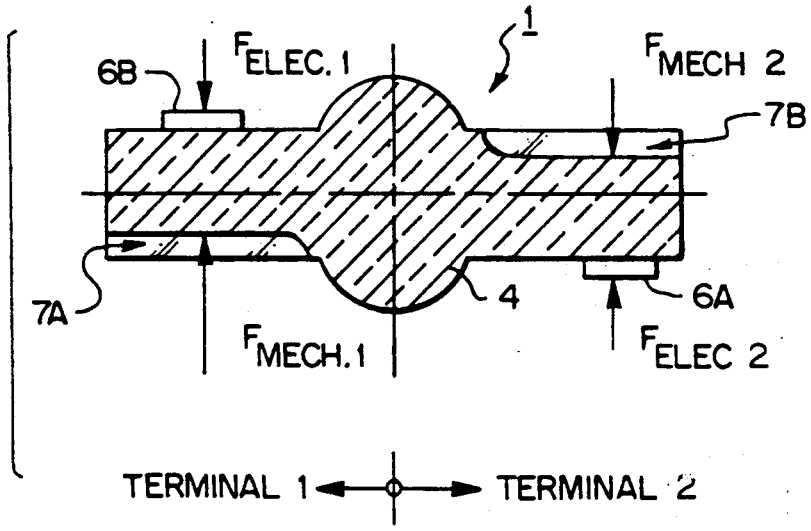
FIG. 4A is a schematic diagram of the preeferred, exem,plary embodiment of FIG. 4 showing the same non-planar forces acting on the bottom or base of the bulb of FIG. 1 as exerted by the spring sections of the terminals of the present invention, with this figure being a cross-section taken along section line A-A' of FIG. 4.

As can be seen in FIGS. 4 & 4A, the mechanical retention forces lie on one plane and are applied directed into the co-planar detents (7A, 7B), while the electrical contact forces are applied on another, spaced plane, toward or at the bottom end portions of the filament wires (6B, 6A, respectively). Thus, the two terminals lc not onlY hold the bulb 1 but also keep it in its desired position and free from rotation or tilt. Here, it should be noted that (as mentioned above) the conventional terminals of the prior art are not capable of keeping the bulb free from rotation, because all of the forces acting on a bulb 1 lie on one and the same plane (note FIG. 3).

As can be seen in FIGS. 5 and 6A & 6B, the mechanical retention spring 13 preferably is a leaf spring clamped at the rear and dimensioned to hold the bulb 1 at its detent.

The electrical contact spring 14 preferably is a torsion spring having approximately a one half (½) winding 14A. Thus, there are two levers or lever arms 14B, 14C attached to this torsion spring. As can be seen, one lever arm 14B is clamped, e.g. at the front of the terminal as illustrated, while the free end of the other arm 14C deflects, as may be required by the dimension of the wedge-base 3 to guarantee a good electrical contact at the rear of the bulb 1. Thus, its length and height or width are preferably dimensioned in such a way that an electrical contact at the rear of the bulb 1 is guaranteed.

As can be seen in the figures, the side of the free lever arm 14C which contacts the wedge-base 3 of the bulb 1 is smooth and flat with out any protrusions or crimped portions, while the mechanical retention spring 13 includes a crimped portion 131, which interdigitates or mates With its respective detent trough 7A/7B. Both of the springs 13 & 14 preferably are integrally formed from the base 12 by being folded up from the sides of the base. As can be further seen and visualized, the springs 13 & 14 are the only parts of the terminal 10 in contact with the side faces of its respective wing 5 of the wedge-base 3 of the bulb 1.

As can best be seen in FIG. 6B the body 12 includes at the ends of its sides, which do not have the mechanical retention spring 13 and the electrical contact spring 14 on them, edges 12B which are curved in toward the interior of the terminal. As would be understood by those of skill in the art, these edges 12B will contact the side edges of the wedge-shaped base of the bulb 1 but not either of its faces. As would be further understood by those of ordinary skill, the curved crimped end portion 13A of the mechanical retention spring 13, the interiorly directed curved side edges 12B and the shelf winding 14A of the electrical spring contact in combination provide a biasing entry into the interior of the terminal for the bulb.

Each terminal 10 may be stamped out of flat metal (e.g. a copper based material, such as, for example, brass) or other conductive material and folded or otherwise formed into the desired shape, for example, the particular, exemplary shape illustrated.

Exemplary dimensions for a subminiature terminal 10 made of brass are outlined below:

| | |
|---|---|
| thickness of metal (stock) | 0.013" |
| overall length of body 10 | 0.750" |
| overall width of body 10 | 0.140" |
| overall height of body 10 | 0.215" |
| lock connector hole 12 | 0.100" square |
| length of spring 13 | 0.200" |

-continued

| | |
|---|---|
| length of spring 14 | 0.400" |

Of course these exemplary dimensions are subject to great variation.

Although this invention has been shown and described with respect to a detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. A snap-in lamp terminal to which an electrically conductive wire is to be attached to connect a wedge-base bulb into a circuit, two of which terminals are used in a socket connector housing for receiving and holding the wedge-base bulb, which wedge-base bulb has a pair of exposed, filament extension wires positioned on opposite sides of the wedge-base, a pair of detent troughs extending transversely to the wedge-base and being lacerated above at least a substantial portion of the filament wires, the wedge-base having a pair of wings on opposite sides of the center line and at the bottom, wedge-base of the bulb, with one wing having one of the detent troughs on one side and having one of the exposed filament wires on its opposite side, with the other wing having on opposite sides the other of the detent troughs and the other of the exposed filament wires, said terminal comprising:

a longitudinally extended base having a at least two end portions and having two, laterally spaced sides;

an electrical wire attachment portion at one end portion of said base; and a bulb gripping portion at another end of said base spaced from said wire attachment portion; said bulb gripping portion having on one side of said base a mechanical retention spring for fitting in and contacting one of the detent troughs of the bulb, said mechanical retention spring being in the form of a leaf spring clamped at the rear and running parallel along the longitudinally length of said base but extending substantially orthogonal up therefrom, and on the other, laterally spaced side of said base an electrical contact spring for contacting a filament wire on the same wing as the detent portion contacted by said mechanical retention spring for providing electrical continuity between the contacted filament wire and the wire attached to said terminal, the contact made with the filament wire by said electrical contact spring being substantially lower down on the bulb then the contact made with the detent trough by said mechanical retention spring, preventing, in combination wit the other terminal, the bulb from rotating within the two terminals, said electrical contact spring being in the form of a torsion spring which also runs parallel along the longitudinally length of said base but extends substantially orthogonal up therefrom on opposite sides of said base from said mechanical retention spring, said torsion spring having approximately a half winding with two, connected, lever arms, one arm being clamped and the other, interior arm facing the interior of the terminal into which the bulb is inserted being free to deflect, the clamped arm of said torsion spring being clamped toward the bulb receiving end of the terminal and the free arm of said torsion spring being smooth and flat along it length on the side which contacts the exposed filament wire all the way to its termination at a length short of but near the bottom end of the wedge-base portion of the bulb, applying electrical contacting force near the bottom end of the wedge-base portion of the bulb but on the side of the bulb, said mechanical retention spring and said electrical contact spring being the only two parts of he terminal in contact with the face and bottom end of a respective wing of the bulb, said mechanical retention spring and said electrical contact spring being folded up from the sides of said base and being integrally formed therewith.

2. The terminal of claim 1, wherein:

said base is rectangular in configuration in its corss-section with a total of two sets of two, laterally spaced sides, said mechanical retention spring and said electrical contact spring being on one set of sides, while the other set of laterally spaced sides terminate in edges which are curved in toward the interior of the terminal.

3. The terminal of claim 1, wherein:

said mechanical retention spring terminates in a curved crimped end portion, said curved crimped end portion, the interiorly directed curved side edges and said half winding of said electrical spring contact providing a biasing entry into the interior of the terminal for the bulb.

4. The terminal of claim 1, wherein:

said base includes a centrally located, locking hole.

* * * * *